US009315048B2

(12) United States Patent
Katagami et al.

(10) Patent No.: US 9,315,048 B2
(45) Date of Patent: Apr. 19, 2016

(54) LIQUID EJECTING APPARATUS

(71) Applicant: SEIKO EPSON CORPORATION, Tokyo (JP)

(72) Inventors: Satoru Katagami, Matsumoto (JP); Jun Yamada, Matsumoto (JP); Motoharu Habata, Wakayama (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/073,720

(22) Filed: Nov. 6, 2013

(65) Prior Publication Data

US 2014/0063164 A1 Mar. 6, 2014

Related U.S. Application Data

(63) Continuation of application No. 12/562,365, filed on Sep. 18, 2009, now Pat. No. 8,636,355.

(30) Foreign Application Priority Data

Sep. 19, 2008 (JP) ..... 2008-241438
Aug. 11, 2009 (JP) ..... 2009-186811

(51) Int. Cl.

| | |
|---|---|
| ***B41J 2/01*** | (2006.01) |
| ***B41J 2/185*** | (2006.01) |
| ***B41J 11/58*** | (2006.01) |
| ***B41J 11/00*** | (2006.01) |
| *B41J 15/16* | (2006.01) |

(52) U.S. Cl.

CPC ..... *B41J 11/58* (2013.01); *B41J 11/002* (2013.01); *B41J 11/0085* (2013.01); *B41J 15/165* (2013.01)

(58) Field of Classification Search

CPC ..... B41J 11/007; B41J 11/06; B41J 2/185; B41J 11/58; B41J 11/002; B41J 11/0085
USPC ..... 347/90, 101, 104
See application file for complete search history.

(56) References Cited

U.S. PATENT DOCUMENTS

| | | | |
|---|---|---|---|
| 7,144,106 | B2 | 12/2006 | Ishii et al. |
| 7,390,085 | B2 | 6/2008 | Ishii et al. |
| 2001/0028380 | A1 | 10/2001 | Wotton et al. |

(Continued)

FOREIGN PATENT DOCUMENTS

| | | |
|---|---|---|
| CN | 1411996 | 4/2003 |
| CN | 1517212 | 8/2004 |

(Continued)

*Primary Examiner* — Kaveh C Kianni
*Assistant Examiner* — Hung Lam
(74) *Attorney, Agent, or Firm* — Workman Nydegger

(57) ABSTRACT

A target supporting apparatus includes a first supporting member having a plurality of first suction holes open to the front surface of the member and the rear surface thereof; a second supporting member having a plurality of second suction holes formed therein and being stacked on and fixed to the first supporting member, the cross-sectional area of each of the plurality of second suction holes being smaller than the cross-sectional area of each of the plurality of first suction holes; and a sucking unit that sucks in the plurality of first suction holes and hence sucks in the plurality of second suction holes communicating with the plurality of first suction holes. Here, a target which is supported in order for a liquid to be adhered thereto is sucked and held onto a supporting face of the second supporting member due to the driving of the sucking unit.

10 Claims, 6 Drawing Sheets

(56) References Cited

U.S. PATENT DOCUMENTS

| | | | | |
|---|---|---|---|---|
| 2002/0031389 | A1* | 3/2002 | Wotton et al. | 400/648 |
| 2002/0060408 | A1* | 5/2002 | Yraceburu et al. | 271/197 |
| 2002/0097311 | A1* | 7/2002 | Hinojosa et al. | 347/104 |
| 2002/0176064 | A1 | 11/2002 | Ida | |
| 2004/0174421 | A1* | 9/2004 | Tsuji | 347/104 |
| 2006/0071997 | A1 | 4/2006 | Kruijt | |

FOREIGN PATENT DOCUMENTS

| | | |
|---|---|---|
| JP | 11-292342 | 10/1999 |
| JP | 2006-130907 | 5/2006 |
| JP | 2006-150723 | 6/2006 |
| JP | 2007-307786 | 11/2007 |

* cited by examiner

LIQUID EJECTING APPARATUS

This application is a Continuation of application Ser. No. 12/562,365, filed Sep. 18, 2009, which claims the benefit of Japanese Patent Application No. 2008-241438, filed Sep. 19, 2008, and Japanese Patent Application No. 2009-186811, filed Aug. 11, 2009, (which are each also expressly incorporated herein by reference in its entirety).

BACKGROUND

1. Technical Field

The present invention relates to a target supporting apparatus for supporting a target onto which a liquid is ejected, a target transporting mechanism having the target supporting apparatus, and a liquid ejecting apparatus having the target supporting apparatus or the target transporting mechanism.

2. Related Art

Generally, ink jet printers (hereinafter, being referred to "a printer") are well known as liquid ejecting apparatuses for ejecting a liquid onto a target (see, for example, JP-A-2006-150723). The printer disclosed in JP-A-2006-150723 includes a platen (a supporting member) for supporting a continuous form paper (a target) and a recording head (a liquid ejecting head) for ejecting an ink (a liquid) onto the continuous form paper supported on the platen. In addition, a plurality of suction holes penetrates through the platen so that the continuous form paper is sucked and held through the suction holes onto the platen.

Further, when the continuous form paper is transported from the upstream side of the transporting direction to the platen, the transportation of the paper stops for a short time, and the paper is sucked and held onto the platen through the suction holes. Then, the recording head ejects ink onto printing regions of the paper while moving above the paper. Thereafter, when this ejection of the ink onto the paper on the platen is completed, the paper is released from the platen, and then, is transported from the platen to the downstream side of the transportation direction.

Moreover, the platen is provided with a heating unit (e.g., a heater) for heating it. Heat from the heating unit is transferred through the platen to the paper on the platen. As a result, while the ink ejected from the recording head onto the paper is being gradually dried by heat on the platen, the paper is transported from the platen to the downstream side of the transportation direction.

In the printer disclosed in JP-A-2006-150723, as shown in FIGS. 6A to 6C, with respect to the continuous form paper 12 sucked onto a platen 27, a temperature T2 of a region C on a sucking suction hole 44 (hereinafter, being referred to "a noncontact region") gets lower than a temperature T1 of regions B being directly contact with the heated platen 27 (hereinafter, being referred to "a contact region") (see FIG. 6A). For this reason, the evaporation level of the solvent in the ink applied onto the paper 12 stopped on the platen 27 is greater in the contact region B in which a rear face of the paper 12 is directly contact with the platen 27 than in the noncontact region C in which the rear face of the paper 12 is positioned on the sucking suction hole 44, thereby causing different drying rates of the ink within the printing regions of the paper 12.

In particular, when the continuous form paper 12 with poor water absorption is used, there are ink flows from the noncontact region C on the sucking suction hole 44 having a lower drying rate to the contact region B on the platen 27 having a higher drying rate. In this way, coloring components which are the solutes contained in the ink as a liquid move from the region C to the region B directly contacted with the platen 27. Further, with appreciating that such an ink flow from the region C to the region B on the continuous form paper 12 arises due to the difference between the temperatures of the regions B, C, even if the platen 27 is not heated, such ink flows may occur. This is because even if the platen is not heated, the temperature of the noncontact region C on the sucking suction hole 44 generally is lower than that of the contact region B.

Accordingly, as shown in FIG. 6B and FIG. 6C, after the drying of the ink is finished, the coloring components get concentrated on the printing region of the paper 12 corresponding to the peripheral region of the sucking suction hole 44, and, hence, coloring levels on the center region and the peripheral region of the suction hole 44 are different from each other, resulting in deteriorating of printing quality (image quality). Further, because the difference in the coloring level occurs between the center region and the peripheral region of the cross-sectional area of the noncontact region C, this difference becomes more pronounced as the cross-sectional area of the suction hole 44 gets larger.

SUMMARY

An advantage of some aspects of the invention is that it provides a target supporting apparatus, a target transporting mechanism, and a liquid ejecting apparatus in which the deterioration of the quality of an image formed on a target is suppressed by adhering a liquid onto the target in a state where the target is being sucked and held onto a supporting member through a plurality of the suction holes.

According to a first aspect of the invention, a target supporting apparatus includes a first supporting member having a plurality of first suction holes open to the front surface of the member and the rear surface thereof; a second supporting member having a plurality of second suction holes formed therein and being stacked on and fixed to the first supporting member, where the cross-sectional area of each of the plurality of second suction holes being smaller than a cross-sectional area of each of the plurality of first suction holes; and a sucking unit that sucks in the plurality of first suction holes and, hence, sucks in the plurality of second suction holes connected to the plurality of first suction holes. Here, a target which is supported in order for a liquid to be adhered thereto is sucked and held onto the supporting face of the second supporting member by the driving of the sucking unit.

According to the first aspect of the invention, the second supporting member having the second suction hole whose the cross-sectional area is smaller than that of the first suction hole of the first supporting member is stacked on and fixed to the first supporting member, and the target is supported on the second supporting member. For this reason, the printing region of the target on one second suction hole of the second supporting member (hereinafter, being referred to "a noncontact region") in this case is smaller than a printing region of the target on one first suction hole in case that the target is directly supported on the first supporting member. Meantime, the liquid applied to the target flows from regions with a lower drying rate to regions with a higher drying rate. In this aspect, the size of a region in which the liquid moves can be reduced by making the size of the noncontact region smaller through the second supporting member having the smaller second suction hole. Consequently, the difference in the coloring levels after a liquid gets dried can be invisible by limiting the region in which the solvent moves along with the solution to a very smaller area, so that the deterioration of the image quality can be suppressed.

It is preferable that the second supporting member has rigidity.

In this case, by fixing and adhering the first supporting member to the second supporting member having the rigidity, the first supporting member gets more rigid, and, at the same time, the target is more reliably supported on the second supporting member.

It is preferable that one first suction hole is communicating with to a plurality of the second suction holes.

Therefore, by communicating one first suction hole with to the plurality of the second suction holes, an entire air flow resistance against the sucking of one first suction hole and the plurality of the second suction holes communicated with one first suction hole gets lower in this case than in case of communicating each first suction hole with each second suction hole. In this way, when the sucking unit with lower sucking ability is used, it sufficiently sucks the target.

It is preferable that the second supporting member is thinner than the first supporting member.

Generally, it is difficult to form a hole with a smaller cross-sectional area in a thicker member. Accordingly, in this case, since the second supporting member is thin, it is easy to form the second suction hole with a smaller cross-sectional area. Further, in this case, even when the second suction hole has the smaller cross-sectional area, the air flow resistance against the sucking with regard to the second suction hole becomes lower as the length of the second suction hole gets shorter according to its thickness.

It is preferable that the target supporting apparatus further includes a heating unit that heats the first supporting member.

In this case, when the first supporting member is heated by the heating unit, heat is transferred from the first supporting member though the second supporting member to the target, and thus the drying process of the liquid on the target gets enhanced. Meantime, because the difference in the temperatures between regions in which the first suction hole of the first supporting member is not formed (hereinafter, being referred to "a contact region") and noncontact regions becomes larger, the liquid tends to flow in parallel with the surface of the target on which the liquid is applied. However, because the liquid flow region is limited to a smaller area as mentioned above, the deterioration of the image quality can be suppressed.

It is preferable that the second supporting member is made of a metal.

In this case, by forming the second supporting member with the metal having excellent thermal conduction ability, heat from the first supporting member heated by the heating unit is efficiently transferred though the second supporting member to the target. Further, because it is easy to transfer the heat to a region of the second supporting member on the first suction hole, the drying rate of the liquid on the noncontact region can be improved.

According to a second aspect of the invention, a target supporting apparatus includes a first supporting member having a plurality of first suction holes open to the front surface and the rear surface thereof and a recess formed in the front surface to communicate with the first suction holes; a second supporting member having a plurality of second suction holes formed therein and being stacked on and fixed to the first supporting member, the cross-sectional area of each of the plurality of second suction holes being smaller than the cross-sectional area of each of the plurality of first suction holes; and a sucking unit that sucks in the plurality of first suction holes and hence sucks in the plurality of second suction holes communicating with the plurality of first suction holes, wherein a target which is supported in order for a liquid to be adhered thereto is sucked and held onto a supporting face of the second supporting member due to the driving of the sucking unit.

According to the second aspect of the invention, the second supporting member having the second suction holes whose cross-sectional area is smaller than that of the first suction hole is stacked on and fixed to the surface of the first supporting member having the first suction holes, and the target is supported on the second supporting member. For this reason, the difference in the coloring levels appearing in the target after a liquid dries can be made invisible by limiting the region in which the solvent attached to the target moves along with the solution to a very smaller area, so that the deterioration of the image quality can be suppressed. Further, by forming the recess communicating with the first suction holes in the surface of the first supporting member, the second suction holes communicating with the first suction holes can be increased. That is, when the sucking unit sucks in the first suction holes, the insides of the second suction holes communicating with the first suction holes via the recess are sucked. Thus, the number of second suction holes exerting a sucking force on the target can be easily increased and a sucking force can act on a wider region in the target to suppress the target from floating up from the supporting face.

In the target supporting apparatus according to the second aspect of the invention, the recess allows the plurality of first suction holes to communicate with each other.

According to this configuration, the recess formed in the surface of the first supporting member communicates with the plurality of first suction holes. Therefore, the second suction holes formed in the second supporting member fixed on the surface of the first supporting member communicate with the plurality of first suction holes via the recess. Thus, in the second suction holes sucked via the recess, variation of the sucking force can be suppressed.

According to a third aspect of the invention, a target transporting mechanism includes the above-mentioned target supporting apparatus; and the transporting unit that transports the target from the upstream side of the transporting direction to a downstream side of the first and second supporting members.

According to the third aspect of the invention, the target which is being transported from the upstream side of the transporting direction to the downstream side of the transporting direction by the transporting unit is sucked and held onto the second supporting member stacked on and fixed to the first supporting member. Thereafter, the liquid is ejected onto the target sucked and held onto the second supporting member, and, then, the target is transported by the transporting unit to the downstream side of the transporting direction. Thus, the drying process of the liquid and the transporting process of the target can be performed continuously, while the image quality of the target is maintained to a good degree.

According to a fourth aspect of the invention, a liquid ejecting apparatus includes the above-mentioned target supporting apparatus or the above-mentioned target transporting mechanism; and a liquid ejecting head that ejects a liquid onto the target supported on the supporting face of the second supporting member.

According to the fourth aspect of the invention, the liquid ejecting head ejects the liquid onto the target sucked and held on the second supporting member. That is to say, while the liquid ejecting head is ejecting the liquid onto the target, the liquid first ejected onto the target evaporates, with the target being sucked and held onto the second supporting member. In this case, the region of the liquid flow occurring on the noncontact region of the target and being in parallel with the surface of the target on which the liquid is applied is limited to a smaller area. For this reason, even when the target remains on the first and second supporting member for a relatively long time and hence much of the solvent component has been evaporated, distribution variations of the solute component can be suppressed and thus the deterioration of the image quality can be suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an ink jet printer used as a liquid ejecting apparatus according to a first embodiment of the invention will be described with reference to the drawings. In following descriptions, directional terms "upward", "downward", "right" and "left" correspond to directions indicated by arrows in FIG. 1. In addition, directional terms "front" and "rear" mean directions perpendicular to the paper surface of FIG. 1 and correspond to directions indicated by an arrow in FIG. 2.

Figure 1:
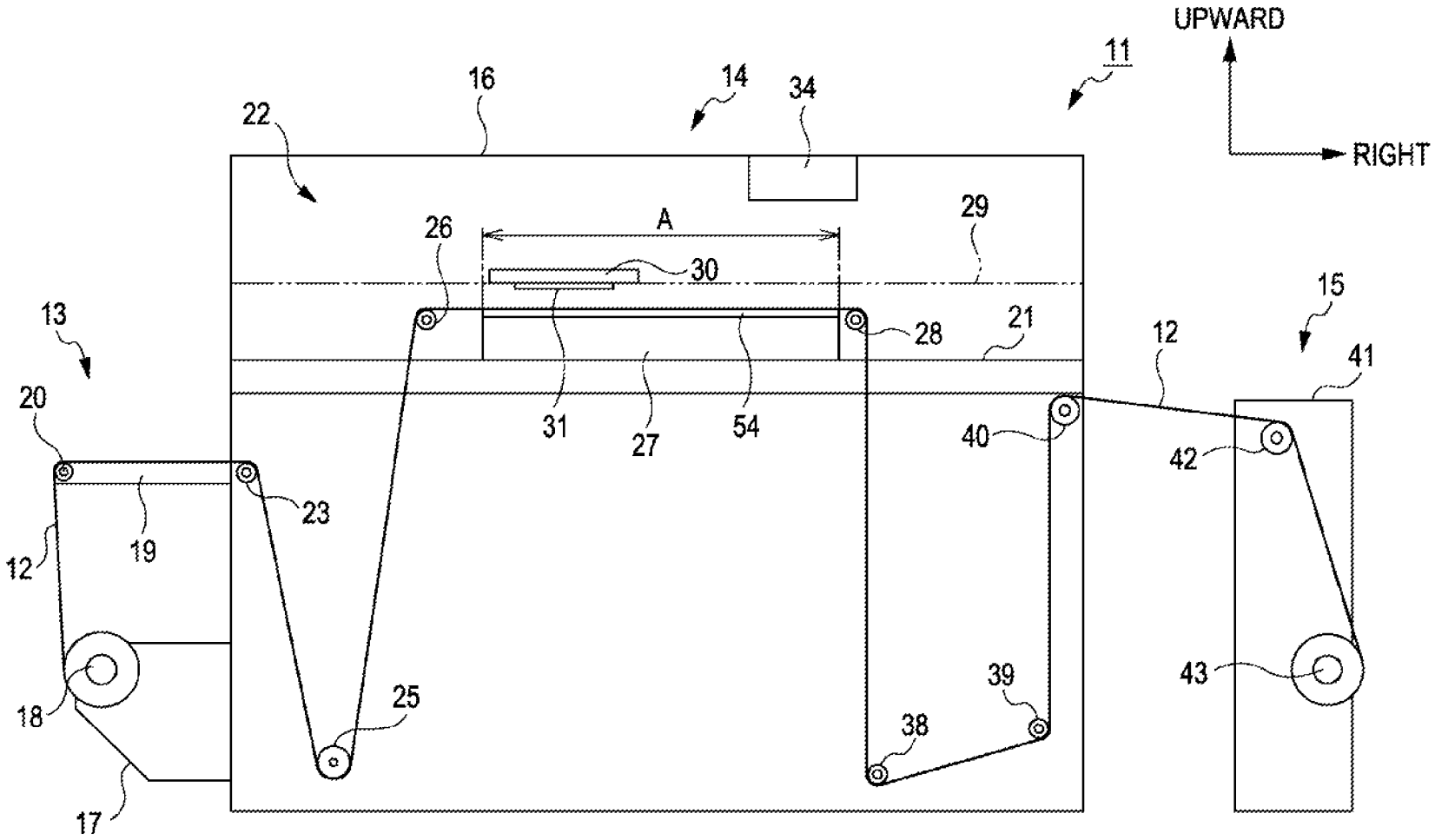
FIG. 1 is a schematic front view of an ink jet printer according to a first embodiment of the invention.

As shown in FIG. 1, the ink jet printer 11 as the liquid ejecting apparatus includes a feeding unit 13 for feeding a continuous form paper 12 having a long shape as a target; a main body 14 for printing sequentially the paper 12 fed from the feeding unit 13; and a winding unit 15 for winding the paper 12 subjected to the printing process of the main body 14. In other words, the main body 14 has a main body case 16 of a rectangular parallelepiped shape, and the feeding unit 13 is installed at the upstream side of a transporting direction of the paper 12, i.e., at the left side of the case 16, and, at the same time, the winding unit 15 is installed at the downstream side of the transporting direction of the paper 12, i.e., at the right side of the case 16.

The feeding unit 13 has a supporting plate 17 extending in the left lower side of the case 16 in a left direction. At a left end of the supporting plate 17, a reel 18 extends toward the front side (the paper front side in a direction perpendicular to the paper surface of FIG. 1) and is supported so that it can rotate by the supporting plate 17. The continuous form paper 12 is wound and supported into a roll shape around the reel 18 so that it rotates together with the reel 18. In this example, the paper 12 is used which has poor water absorption or with water-repellent properties, so that an ink ejected onto the paper 12 tends to get dried on the surface of the paper 12.

The feeding unit 13 has a plate-type feeding table 19 extending horizontally from the left-centered side of the case 16 on the left side. At a tip-end of the table 19, a relay roller 20 which winds the paper 12 fed from the reel 18 and guides it to the upper face of the table 19 is supported so that it can rotate. Then, the paper 12 is transported along the upper face of the table 19 to the right side (the main body 14 side).

A plate-type base table 21 which partitions the space in the case 16 into upper and lower sections, is placed at a slightly more upward position than the center position in the upward and downward direction within the case 16 of the main body 14. The upper section of the case 16, which is located higher up than the base table 21, is a printing chamber 22 for printing the paper 12.

Although not shown in FIG. 1, a carrying-into hole for carrying the paper 12 from the upper face of the feeding table 19 into the case 16 is located on the left wall of the case 16. A pulling-in driving roller 23 used as a transporting means is installed so that it can rotate at a position near and facing away from the carrying-into hole within the case 16 of the main body 14. The driving of the rotation of the roller 23 is controlled based on a control signal from a controller (not shown).

A relay roller 25 is installed so that it can rotate on the right lower diagonal side of the pulling-in driving roller 23 within the case 16. The paper 12 pulled by the driving of the roller 23 into the case 16 is wound around the relay roller 25 from the left lower side of the roller 25 so that it is transferred toward a position near the left-end of the printing chamber 22.

A relay roller 26 is located within the printing chamber 22 at the right upper diagonal side of the relay roller 25. The paper 12 relayed from the roller 25 is wound around the relay roller 26 from the left lower side so that it is directed horizontally to the right side.

In the right side of the relay roller 26 within the printing chamber 22, a plate-type platen 27 of a rectangular shape used as a first supporting member is supported on the base table 21. A cover member 54 of a rectangular shape used as a second supporting member is stacked on and fixed to the platen 27. More specific configurations of the cover member 54 will be described later. A turning roller 28 facing away the relay roller 26, with interposing the platen 27 between them, is installed at the right side of the platen 27. In this case, upper faces of the relay roller 26, the cover member 54 and the turning roller 28 are in the same height and located in the same plane.

The paper 12 transported from the relay roller 26 in a horizontal direction along the upper face of platen 27 is wound around the turning roller 28 from the left upper side of the roller 28 so that the moving direction of the paper 12 changes from a horizontal direction to a vertical-downward direction. The paper 12 whose transporting direction has been switched to the vertical-downward direction moves in the vertical-downward direction through an inserting hole (not shown) installed at the base table 21 by the roller 28.

A pair of guide rails 29 (shown as a double-dashed chain line in FIG. 1) extending in a right-left direction is located at both of front and rear sides of the platen 27 within the printing chamber 22. The height of an upper face of the guide rails 29 is higher than that of the cover member 54 stacked on the platen 27. A carriage 30 of a rectangular shape is supported so as to reciprocate upper faces of both the rails 29 in the right-left direction along both the guide rails 29. The carriage 30 reciprocates on both the rails 29 in the right-left direction, based on a control signal from a controller (not shown).

Although not shown in FIG. 1, a sliding plate is supported on a lower face of the carriage 30 so as to slide against the carriage 30 in a front-rear direction. A recording head 31 as a liquid ejecting head is held on a lower face of the sliding plate. Valve units 34 for temporally retaining the ink are installed on the upper wall of the case 16 within the printing chamber 22. Inks with different colors are temporally retained within each valve unit 34.

Each valve unit 34 is coupled to the recording head 31 through each of ink supplying tubes (not shown), and supplies each ink through each of the ink supplying tubes into the recording head 31. A plurality of nozzle openings (not shown) is provided in the lower face of the recording head 31. Each ink supplied from each valve unit 34 is ejected through each nozzle opening onto the paper 12 transported on the platen 27 and stopped, so that the printing process is performed.

Therefore, across the transporting path of the paper 12, a region between left and right ends of the platen 27 becomes the printing region A on which the printing process is performed. The paper 12 is transported intermittently along the transporting path one region at a time where each region corresponds to the printing region A.

The recording head 31 ejects the inks onto the printing region A of the paper 12, while moving in a right-left direction above the printing region A of the paper 12 by following the right-left directional movements of the carriage 30. Further, the recording head 31 ejects the inks onto the printing region A of the paper 12, while moving in a front-rear direction above the printing region A of the paper 12 by following the front-rear directional movements of the sliding plate.

As shown in FIG. 1, the paper 12, which is wound around the turning roller 28 and moved in the vertical-downward direction by the turning roller 28, is wound around an inversion roller 38 from the left upper side of the roller 38, the roller 38 being installed so that it can rotate in a vertical-downward directional side of the turning roller 28 within the case 16. Then, the paper 12 is moved toward the slightly-sloped right upward direction. Thereafter, the paper 12 transported from the inversion roller 38 is wound around a relay roller 39 from the left lower side of the roller 39, the roller 39 being installed so that it can rotate at the right directional side of the inversion roller 38 within the case 16. Then, the paper 12 is moved upward along the right wall of the case 16 within the case 16. After the printing region A of the paper 12 has been printed, it gets dried naturally while moving within the case 16.

Although not shown in FIG. 1, a carrying-out hole for carrying the paper 12 out of the case 16 into the winding unit 15 is installed on the right wall of the case 16 at a position near the base table 21. A sending-out driving roller 40 used as a transporting means is installed so that it can rotate at a position near and facing away the carrying-out hole within the case 16. Then, by driving the sending-out driving roller 40 based on a control signal from a controller (not shown), the paper 12 is moved through the carrying-out hole into the winding unit 15.

The winding unit 15 has a winding frame 41 of a rectangular parallelepiped shape whose height is substantially the same as that of the sending-out driving roller 40. A relay roller 42 is installed so that it can rotate within the frame 41 on the upper end of the winding frame 41, and the paper 12 moved from the carrying-out hole is wound around the relay roller 42 from the left upper side of the roller 42, so that it moves in the right lower diagonal direction.

A winding-driving shaft 43 used as a transporting means, is located at a right lower diagonal side of the relay roller 42 within the winding frame 41 and extends toward the front side. The winding-driving shaft 43 is supported so that it can rotate by the winding frame 41. The paper 12 transported in a right lower diagonal direction from the relay roller 42 is wound around the winding-driving shaft 43. By driving and rotating the winding-driving shaft 43 based on a control signal from a controller (not shown), the paper 12 is sequentially wound around the shaft 43.

Figure 2:
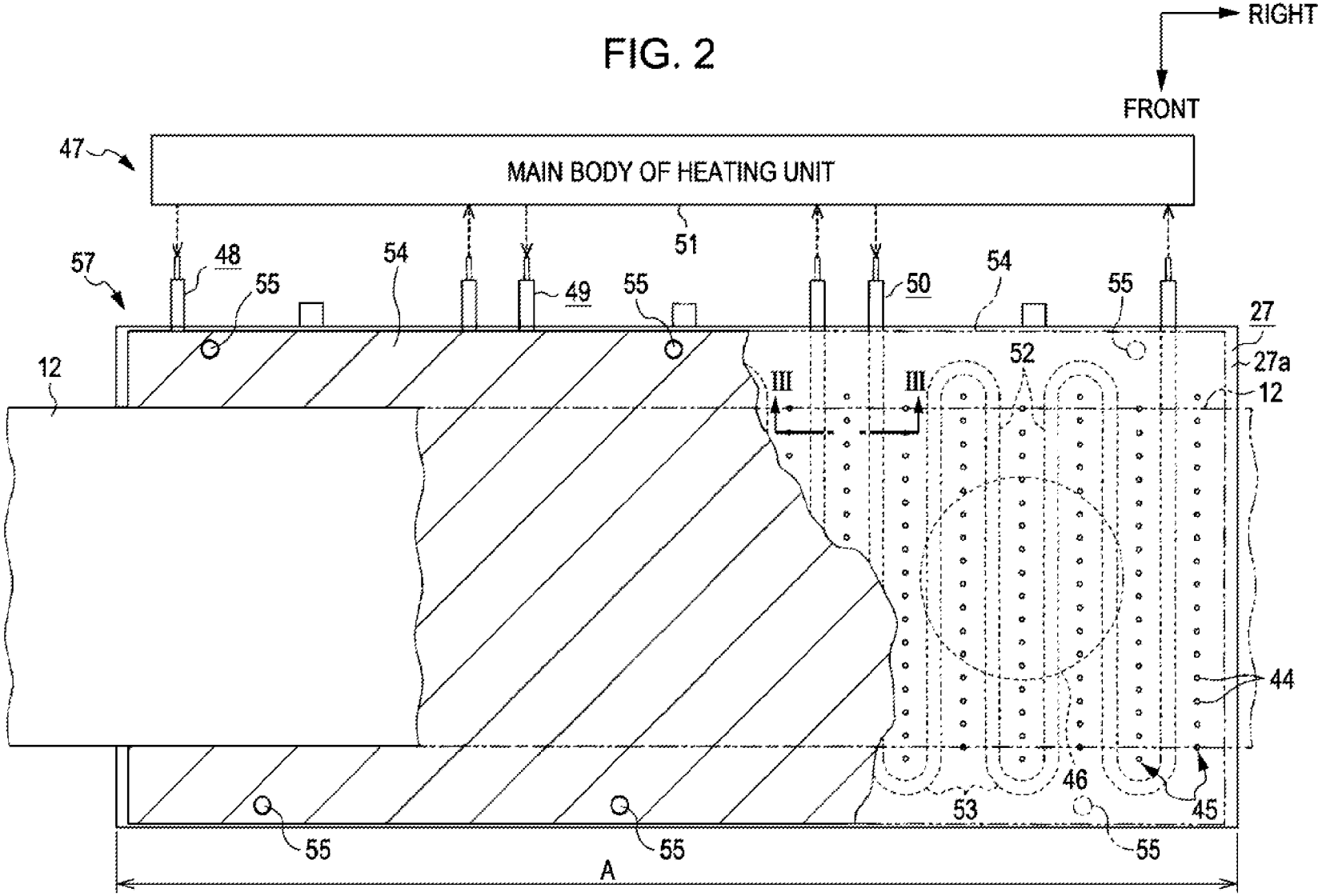
FIG. 2 is a plan view of a platen of the ink jet printer.

Next, the configuration of the platen 27 will be described with reference to FIG. 2. As shown in FIG. 2, the platen 27 has a plurality of first sucking suction holes 44 penetrating through the platen 27 in an upward lower direction (a thickness direction of the platen 27). In other words, the sucking suction holes 44 open a surface 27*a*, i.e., the upper face of the platen 27 and a rear face 27*b*, i.e., the lower face of the platen 27 (see FIG. 3). Here, an aperture diameter of the suction hole 44 on the surface 27*a* is equal to an aperture diameter of the suction hole 44 on the rear face 27*b*, and, hence, an aperture cross-sectional area of the suction hole 44 on the surface 27*a* is equal to an aperture cross-sectional area of the suction hole 44 on the rear face 27*b*.

The plurality of the sucking suction holes 44 are configured so that a number of the suction holes 44 (the number being 16 in FIG. 2) are arranged in the front-rear direction as one column 45, and a number of the columns 45 are regularly arranged in the right-left direction and are spaced each other by a given distance. A sucking fan 46 (a sucking unit) to create a sucking force in each suction hole 44 is installed beneath the platen 27 (i.e., in a region between the platen 27 and the base table 21), and, at the same time, a surrounding member (not shown) for surrounding the apertures of the sucking suction holes 44 on the rear face 27*b* is installed beneath the platen 27. Thus, there is negative pressure within the spaces of the sucking suction holes 44 due to the driving of the sucking fan 46.

Next, a heating unit 47 for heating the platen 27 will be described with reference to FIG. 2. As shown in FIG. 2, this heating unit 47 includes a number of heaters 48, 49, and 50 (in this example, the number being 3) as heating means buried in the platen 27, and a main body 51 for separately supplying electrical currents to each heater 48, 49 and 50 in order for each heater 48, 49 and 50 to emit the heat. The heaters 48, 49 and 50 are formed in the same shape, and are arranged at different positions in the right-left direction within the platen 27. The individual current from the main body 51 is separately supplied to each heater 48, 49, and 50 which, in turn, emits heat. The platen 27 has a thickness (in this example, being about 25 mm) enough to maintain heat from each heater 48, 49 and 50 and, hence, to enhance the drying rate of the ink adhered to the paper 12.

Each heater 48, 49, and 50 is formed by bending each lengthy member at many points. To be specific, each heater 48, 49 and 50 includes a number of first heating portions 52 (in this example, the number being 6) extending in the front-rear direction, each first heating portion 52 being disposed between the neighboring suction hole columns 45 in the right-left direction; and a number of second heating portions 53 (in this example, the number being 5) connecting the neighboring first heating portions 52 each other in the right-left direction, with one suction hole column 45 be disposed between the neighboring first heating portions 52.

Each length of the first heating portions 52 in the front-rear direction is larger than each length of the suction hole columns 45 in the front-rear direction. Further, each of the first heating portions 52 is disposed at a center region between the neighboring suction hole columns 45 in the right-left direction.

In this way, across the entire region of the platen 27, there are temperature differences between regions in which one of the sucking suction holes 44 is formed (hereinafter, being referred to "low temperature regions") and regions in which one of the sucking suction holes 44 is not formed (hereinafter, being referred to "high temperature regions").

Figure 3:
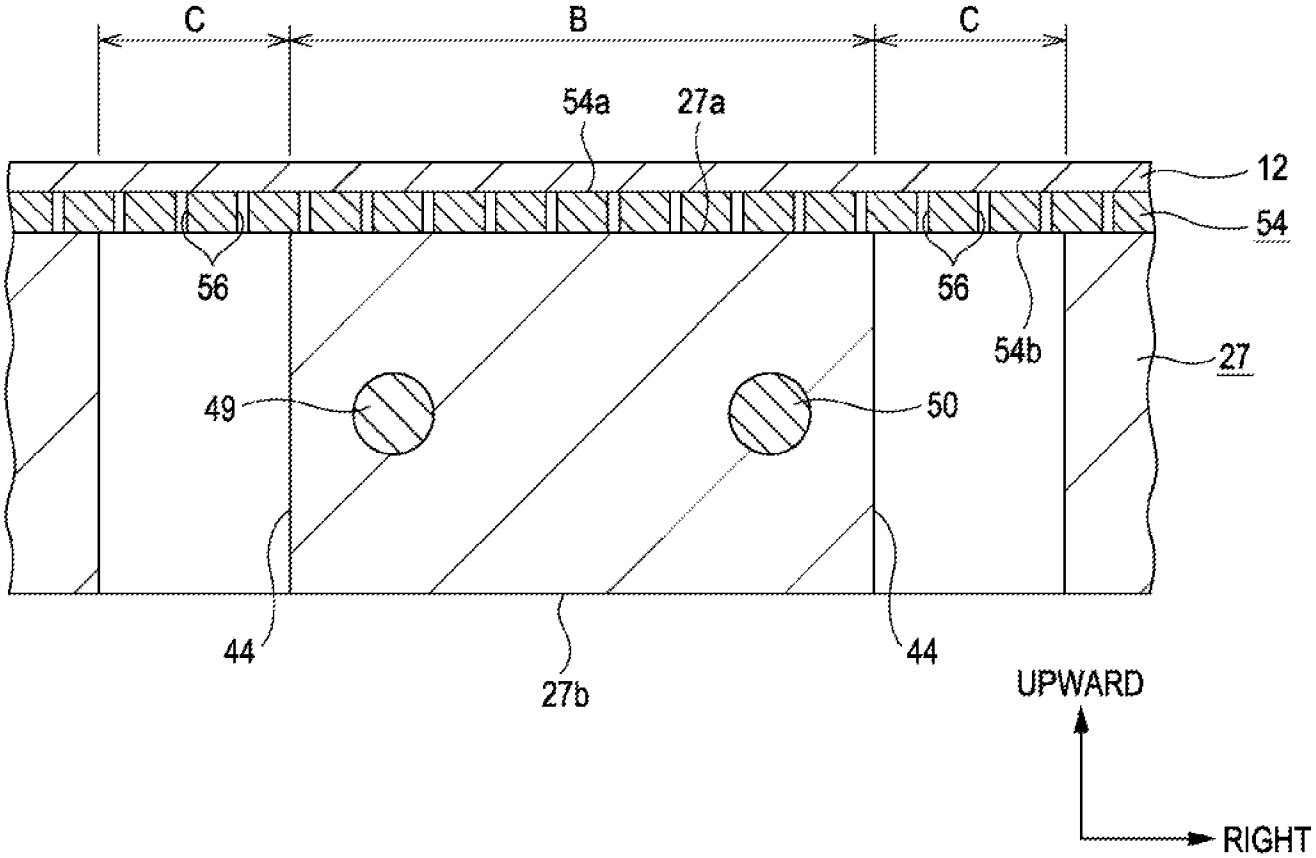
FIG. 3 is a schematic cross-sectional view taken with a line 3-3 in FIG. 2.

As shown in FIG. 2 and FIG. 3, the cover member 54 of a rectangular shape used as a second supporting member is stacked to cover the surface 27*a* of the platen 27 and fixed thereto by a number of screws 55 (in this example, the number being 6). The paper 12 transported onto the platen 27 is held on a supporting face 54*a*, i.e., the upper face of the cover member 54. As mentioned above, the supporting face 54*a* of the cover member 54, the upper face of the relay roller 26 and the upper face of the turning roller 28 are the same height and in the same plane.

The cover member 54 is a plate made of metal having rigidity and high thermal conductance (in this example, the metal being aluminum). The cover member 54 has a plurality of second sucking through holes 56 penetrating through the cover member 54 in an upward-downward direction (a thickness direction of the cover member 54) achieved by punch-cutting the cover member 54. In other words, the sucking through holes 56 open the supporting face 54*a*, i.e., the upper face of the cover member 54 and a lower face 54*b* of the cover member 54.

Here, an aperture diameter of the through hole 56 on the supporting face 54*a* is equal to an aperture diameter of the through hole 56 on the lower face 54*b*. It should be noted that the aperture cross-sectional area of the second sucking through hole 56 (in this example, the aperture diameter of the second sucking through hole 56 being about 0.5 mm) gets smaller than the aperture cross-sectional area of the first sucking suction hole 44 (in this example, the aperture diameter of the first sucking suction hole 44 being about 4 mm). Further, the intervals (pitch) between the neighboring sucking through holes 56 are smaller than the intervals (pitch) between the neighboring sucking suction holes 44.

When the lower face 54*b* of the cover member 54 and the surface 27*a* of the platen 27 are adhered and fixed to each other in a plane contacting way, one of the sucking suction holes 44 (i.e., one sucking suction hole 44) is communicating with a plurality of the through holes 56. Thus, the negative pressure occurring in each of the suction holes 44 due to the driving of the sucking fan 46 is transferred into the through holes 56 communicating with each of the suction holes 44. Then, the paper 12 on the platen 27 and the cover member 54 is sucked through the first and second suction holes 44 and 56 by the negative pressure, thereby sucking in and holding the paper 12 on the supporting face 54*a* of the cover member 54. Meantime, FIG. 3 exaggerates the suction holes 44 and the through holes 56 so that it is easy to compare the aperture diameter of the suction holes 44 with the aperture diameter of the through holes 56.

The thickness of the cover member 54 (in this example, being about 0.4 mm) is small enough to fabricate the member 54 into a mesh shape and, at the same time, is defined so that the flat plane state of the supporting face 54*a* is maintained even in cases where there is negative pressure within the space of the through holes 56. Moreover, when each heater 48, 49 and 50 heats the platen 27, heat is transferred from the high temperature region of the platen 27 to the cover member 54, and, then, to the continuous form paper 12 on the cover member 54.

Because the cover member 54 is made of the metal with good thermal conductance, heat can be transferred to regions of the cover member 54 located on the low temperature regions of the platen 27 in which the suction hole 44 is formed, so that the entire region of the cover member 54 is heated to substantially the same temperature. On the other hand, the noncontact region C of the paper 12 in which the suction hole 44 is formed on the cover member 54 is divided into contact regions to which heat transfers directly and noncontact regions to which heat transfers at a smaller amount than to the contact regions due to the through hole 56. For this reason, across the noncontact region C of the paper 12, the ink applied to the paper 12 flows toward the regions which are contact with the supporting face 54*a* of the cover member 54 and, hence, in which the drying rate of the ink becomes higher. However, the noncontact region in which the through hole 56 is formed is much narrower than the noncontact region C, the difference in the coloring level in the noncontact region in which the through hole 56 is formed can be suppressed.

In this embodiment, the continuous form paper supporting apparatus 57 used as the target supporting apparatus includes the above-mentioned platen 27, sucking fan 46 and cover member 54. Additionally, the target transportation mechanism includes the paper supporting apparatus 57, the pulling-in driving roller 23, the sending-out driving roller 40 and the winding-driving shaft 43.

In the operation of the ink jet printer 11, in particular, the drying operation of the ink adhered to the paper 12 on the platen 27 heated by the heaters 48, 49 and 50 will be explained. Meantime, both front and rear ends of the paper 12 on the platen 27 are positioned inside those of the cover member 54.

When the printing process of the paper 12 begins to be performed by the ink jet printer 11, air in the suction holes 44 is absorbed out by the driving of the fan 46 beneath the platen 27 for the paper 12 transported into the printing region A. Thus, regions on the paper 12 supported through the through holes 56 on the cover member 54 are sucked onto the supporting face 54*a* of the cover member 54.

When heat emitted from the heaters 48, 49 and 50 due to the driving of the main body 51, heat transfers through the platen 27 to the cover member 54. When the paper 12 on platen 27 is printed (i.e., ink is ejected from the recording head 31 moving in the right-left direction and the upward-downward direction), the ink applied to the paper 12 does not penetrate into the paper 12 but remains on the surface thereof. Then, the ink solvent (e.g., water or organic solvent) evaporates from the ink first applied to the paper 12 due to heat from the platen 27 and the cover member 54, while the paper 12 is sucked and fixed onto the platen 27. Here, even when the ink flow occurs in the noncontact region C, the ink flow regions in the noncontact region C are limited to smaller areas. Accordingly, the ink applied onto the printing region A is prevented from moving from the noncontact region C to the contact region B in large quantities. In this manner, the coloring components in the ink (e.g., pigment or dyes) is adhered and fixed to a position onto which the ink was ejected, or a position which is slightly deviated from a position onto which the ink was ejected.

Thereafter, when the printing process of the printing region A is completed, the driving of the sucking fan 46 is stopped by a controller (not shown), and, hence, the paper 12 is released from the cover member 54. At the same time, the pulling-in driving roller 23, the sending-out driving roller 40 and the winding-driving shaft 43 are driven, and, then, the paper 12 is transported to the winding unit 15 side.

According to the first embodiment of the invention, following technical effects are attained. (1) The cover member 54 having the sucking through hole 56 whose the cross-sectional area is smaller than that of the sucking suction hole 44 of the platen 27 is stacked on and fixed to the platen 27, and the paper 12 is supported on the cover member 54. For this reason, the printing region of the paper 12 on one sucking through hole 56 of cover member 54 in this case is smaller than the printing region of the paper 12 on one sucking suction hole 44 in case that the paper 12 is directly supported on the platen 27 (the noncontact region C). Meantime, the ink applied to the paper 12 flows from regions with a lower drying rate to regions with a higher drying rate. In this case, the size of regions in which the ink moves can be reduced by dividing the noncontact region C into a plurality of smaller regions through the cover member 54 having the smaller sucking through holes 56. Consequently, the difference in the coloring levels on the paper 12 after completion of the ink drying can be made to be invisible by limiting the region in which the solvent moves along with the solution to smaller area, so that the deterioration of the image quality can be suppressed.

(2) By fixing and adhering the platen 27 to the cover member 54 having the rigidity, the platen 27 gets more rigid, and, at the same time, the paper 12 is more reliably supported on the cover member 54. (3) By communicating one of the plurality of sucking suction holes 44 with a plurality of sucking through holes 56, the entire air flow resistance against the sucking of one of the plurality of sucking suction holes 44 and the plurality of sucking through holes 56 communicating with one of the plurality of sucking suction holes 44 is lower in this case compared to the case of communicating each sucking suction hole 44 with each second sucking through hole 56. In this way, when the sucking unit 46 with lower sucking ability is used, it sufficiently sucks the paper 12.

(4) Generally, it is difficult to form a hole with a smaller cross-sectional area in a thicker member. Accordingly, by using the thinner cover member 54, it is easy to form the sucking through hole 56 with a smaller cross-sectional area. Further, even when the sucking through hole 56 has a smaller cross-sectional area, the air flow resistance against the sucking with regard to the sucking through hole 56 becomes lower as the length of the sucking through hole 56 gets shorter.

(5) When the platen 27 is heated by the heaters 48, 49 and 50, heat is transferred from the platen 27 though the cover member 54 to the paper 12, and thus the drying process of the ink on the paper 12 gets enhanced. Meantime, because the difference in the temperature between regions in which the sucking suction hole 44 of the platen 27 is not formed (the contact region B) and noncontact regions C becomes larger, the ink tends to flow in parallel with the surface of the paper 12 on which the ink is applied. However, because the ink flow region is limited to a smaller area on the cover member 54 as mentioned above, the deterioration of the image quality can be suppressed.

(6) Because the second supporting member can be made of metal with excellent thermal conduction ability, heat from the platen 27 heated by the heaters 48, 49 and 50 is transferred efficiently though the cover member 54 to the paper 12. Further, because it is easy to transfer heat to regions of the cover member 54 on the sucking suction hole 44 due to the excellent thermal conduction ability, the drying rate of the ink on the noncontact region C can be improved.

(7) The paper 12 which is being transported from the upstream side of the transporting direction to the downstream side of the transporting direction due to the driving of the pulling-in driving roller 23, the sending-out driving roller 40 and the winding-driving shaft 43, is sucked and held onto the cover member 54 stacked on and fixed to the platen 27. Thereafter, the ink is ejected onto the paper 12 sucked and held onto the cover member 54, and then the paper 12 is transported by the transporting unit to the downstream side of the transporting direction. Thus, the drying process of the ink and the transporting process of the paper 12 can be performed continuously, while the image quality of the paper 12 is maintained to a good degree.

(8) The recording head 31 ejects the ink onto the paper 12 held and stopped on the cover member 54. That is to say, while the recording head 31 is ejecting the ink onto the paper 12, the ink first ejected onto the paper 12 evaporates, as the paper 12 is being sucked and held onto the cover member 54. In this case, the region of the ink flow occurring on the noncontact region C of the paper 12 and being in parallel with the surface of the paper 12 on which the ink is applied is limited to a smaller area as mentioned above. For this reason, even when the paper 12 remains on the platen 27 and the cover member 54 for a relatively long time and, hence, much of the solvent component has been evaporated, variation in distribution of the solute components can be suppressed and, thus, the deterioration of the image quality can be suppressed.

Second Embodiment

Next, a second embodiment of the invention will be described with reference to FIGS. 4 and 5. The second embodiment differs from the first embodiment only in that a surface shape of the platen 27 is changed, and otherwise, the configurations are the same, so that similar constituents are designated with the same reference numbers and detailed repeated descriptions thereof will be omitted.

Figure 4:
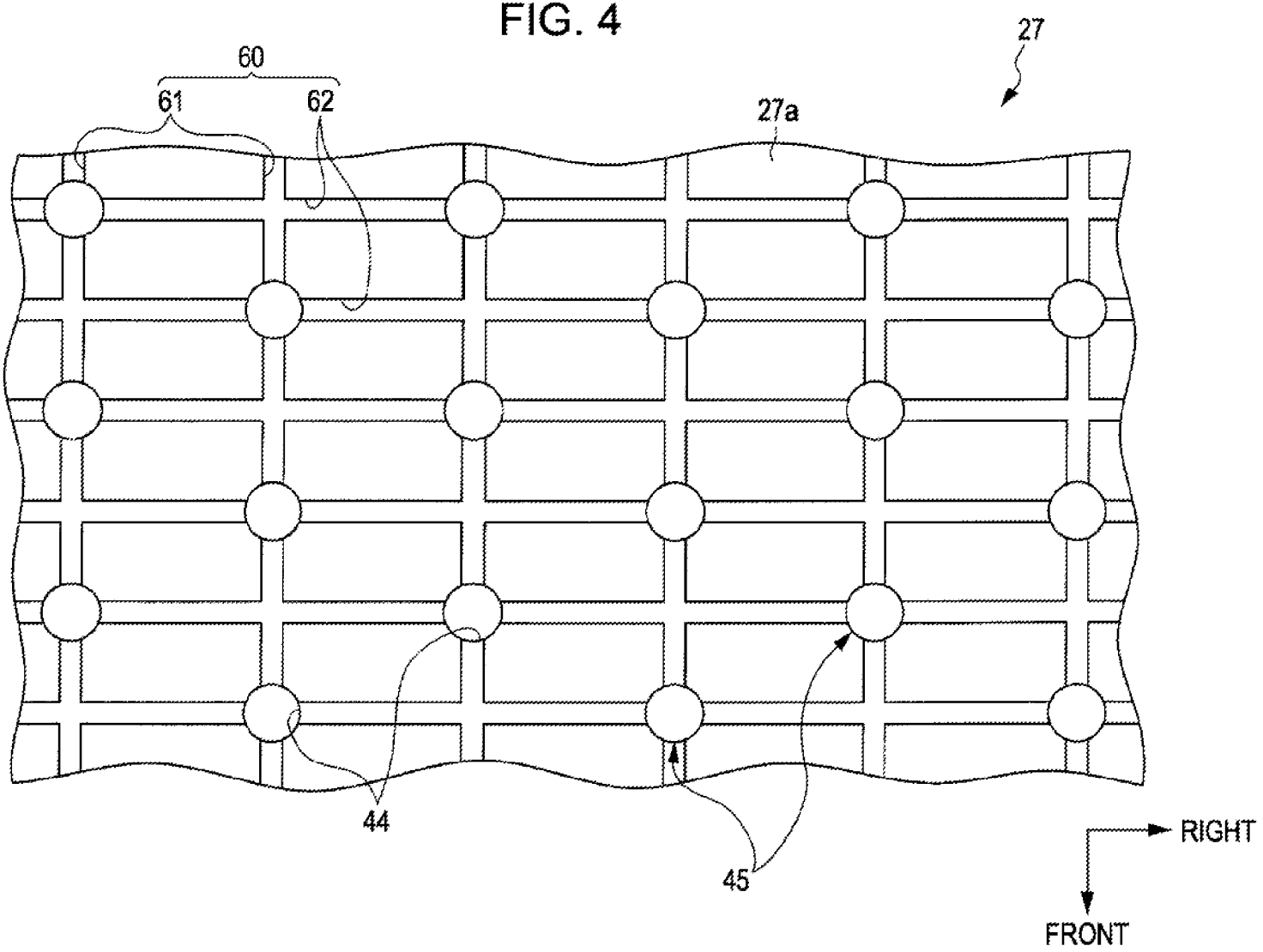
FIG. 4 is an enlarged plan view of a platen of the printer according to a second embodiment of the invention.

As shown in FIG. 4, a groove-shaped recess 60 is formed in the surface 27*a* of the platen 27 so as to communicate with the suction holes 44 open to the surface 27*a*. That is, the recess 60 is formed in a lattice-like shape by a plurality of first recesses 61 formed in the front-rear direction so as to allow the suction holes 44, which constitute the respective suction hole columns 45, to communicate with each other and a plurality of second recesses 62 formed in the right-left direction so as to allow the suction holes 44, which are adjacent to each other in the right-left direction, to communicate with each other.

Both a width of the first recess 61 and a width of the second recess 62 are larger than an opening diameter of the through hole 56 formed in the cover member 54, and are smaller than an opening diameter of the suction hole 44.

Figure 5:
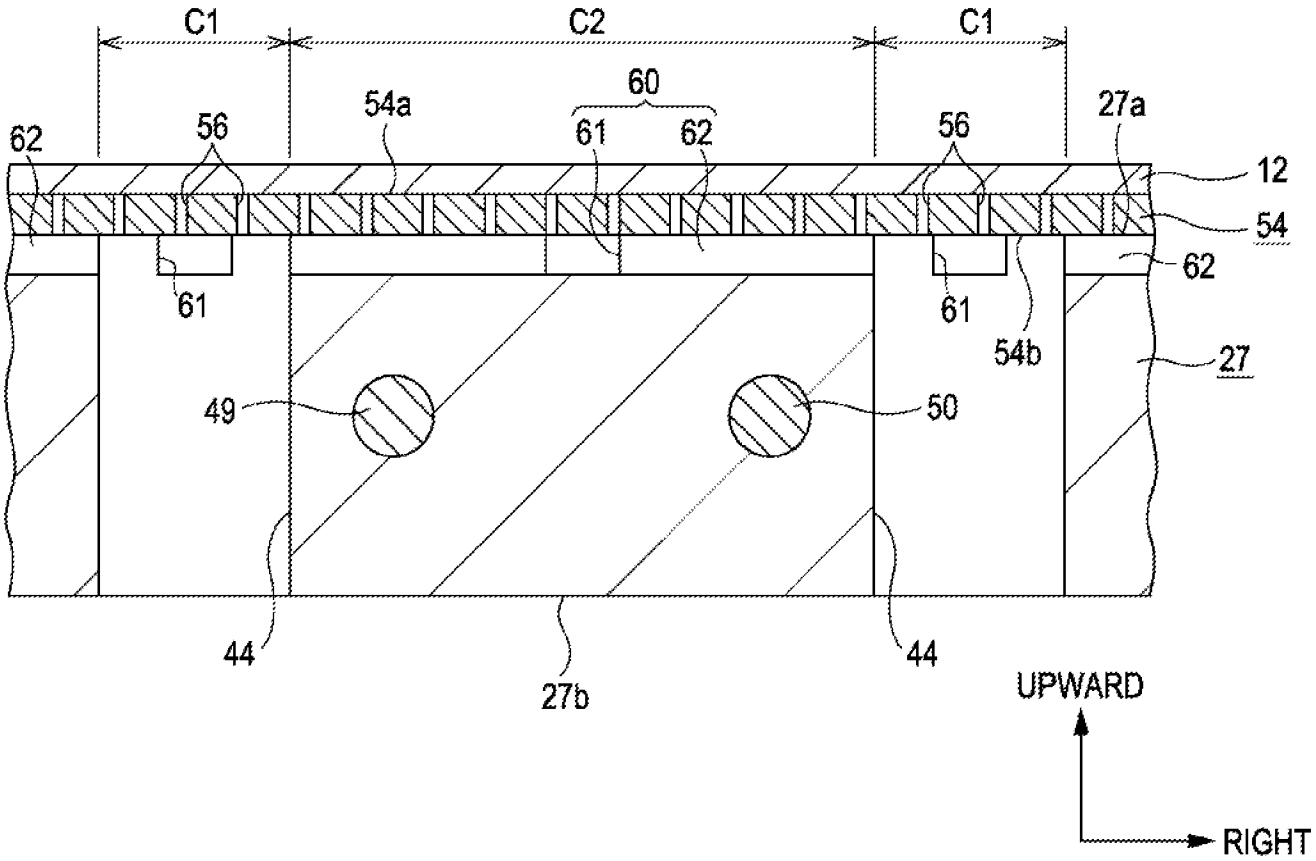
FIG. 5 is a schematic cross-sectional view of the platen and a cover member.
Figure 6A:
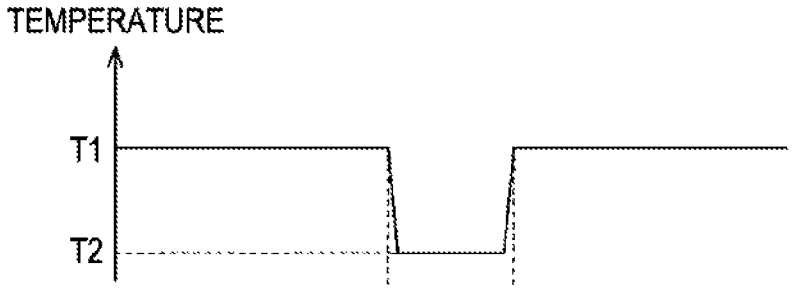
FIG. 6A is a temperature graph when a known printer performs a printing process.
Figure 6B:
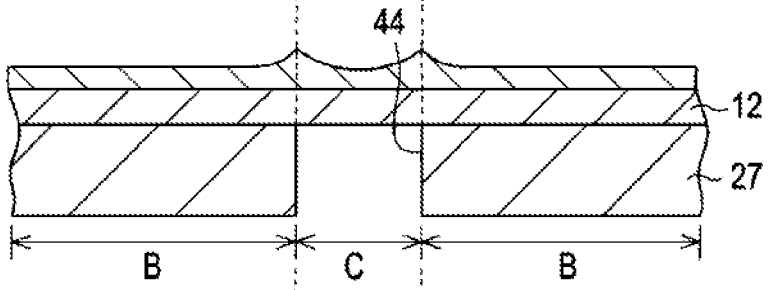
FIG. 6B shows a printing state.
Figure 6C:
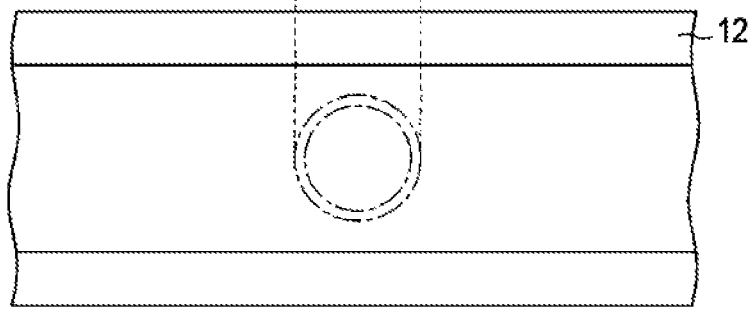
FIG. 6C shows a plan view of a continuous form paper after an ink has been dried.

Therefore, as shown in FIG. 5, when the cover member 54 is fixed on the surface 27*a* of the platen 27 in a stacked state, an opening of the recess 60 is blocked by the cover member 54 and the through holes 56 located on the recess 60 communicate with the plurality of suction holes 44 via the recess 60. Therefore, a negative pressure generated in each suction hole 44 in response to the driving of the fan 46 is transmitted into the through holes 56 formed on the suction hole 44, and into the through holes 56 in communication via the recess 60. In FIG. 5, for easy comparison of opening diameters and opening widths of the suction hole 44, through hole 56 and the recess 60, the suction hole 44, through hole 56 and the recess 60 are shown in a magnified manner.

The cover member 54 is formed of metal having good thermal conductivity. Therefore, when the heaters 48, 49 and 50 heat the platen 27, the heat is transferred to a region of the cover member 54 located on the recess 60, similar to a region located on the suction hole 44 which becomes a low temperature region of the platen 27, so that the whole of the cover member 54 is heated to substantially the same temperature.

That is, the continuous form paper 12, a first noncontact region C1 located on the suction holes 44 and a second noncontact region C2 located on the recess 60 are divided into regions which are located on the cover member 54 so that heat is directly transferred, and regions which are located on the through holes 56 so that heat is not directly transferred from the cover member 54. Therefore, in the first noncontact region C1 and the second noncontact region C2, the ink attached to the continuous form paper 12 is caused to generate a flow in the regions located on the through holes 56, toward the regions contacting the supporting face 54*a* of the cover member 54 so that drying is promoted, but these regions are narrower than the first noncontact region C1 and the second noncontact region C2, so that the generation of irregular color (coloring level difference) is suppressed.

Next, an operation of the ink jet printer 11 according to the present embodiment will be described mainly covering an operation when the ink is attached to the continuous form paper 12 adsorbed on the supporting face 54*a* in accordance with the driving of the fan 46 and dried. The continuous form paper 12 disposed on the platen 27 is set such that opposite ends (opposite edges) in the front-rear direction thereof are positioned inside opposite ends of the cover member 54.

When each fan 46 is driven in a state where the continuous form paper 12 is transported to the printing region A, air inside each suction hole 44 is sucked. Then, the insides of the through holes 56 located on the suction hole 44, and the through holes 56 communicating with the suction hole 44 via the recess 60 are sucked, so that a sucking force is applied to the first noncontact region C1 and the second noncontact region C2 in the continuous form paper 12.

That is, in the continuous form paper 12, an area in the continuous form paper 12 on which a sucking force acts is larger than that of a case where a sucking force acts on only the first noncontact region C1 by the through holes 56 located on the suction hole 44. Therefore, for example, even in a case where the heated continuous form paper 12 is expanded, the continuous form paper 12 is suppressed from floating up from the supporting face 54*a* and is supported in a stable state.

When the heaters 48, 49 and 50 are heated due to the driving of the main body 51, heat of the heaters 48, 49 and 50 is transferred to the cover member 54 via the platen 27. In a state where the continuous form paper 12 supported on the cover member 54 is heated via the cover member 54, when the ink is ejected from the recording head 31, the ink solvent evaporates from the ink that previously landed on the continuous form paper 12.

At this time, in the first noncontact region C1 and the second noncontact region C2, a flowing range of the ink located on the through holes 56 becomes narrower than the first noncontact region C1 and the second noncontact region C2. Therefore, even when the flow of the ink is generated in the first noncontact region C1 and the second noncontact region C2, the flowing range thereof is narrow. Thus, the ink ejected within the printing region A is suppressed from generating a large flow directed from the first noncontact region C1 and the second noncontact region C2 toward the contact region B. Therefore, coloring components in the ink are fixed at an ejected position or a position slightly deviated from the ejected position.

According to the second embodiment, in addition to the advantages (1) to (8) of the first embodiment, the following advantages can be attained.

(9) By forming the recess 60 communicating with the suction holes 44 in the surface 27*a* of the platen 27, the through holes 56 communicating with the suction holes 44 can be increased. That is, when the fan 46 sucks in the suction holes 44, the insides of the through holes 56 communicating with the suction holes 44 via the recess 60 are sucked. Thus, the number of through holes 56 exerting a sucking force on the continuous form paper 12 can be easily increased and a sucking force can act on a wider region in the continuous form paper 12 to suppress the continuous form paper 12 from floating up from the supporting face 54*a*.

(10) The recess 60 formed in the surface 27*a* of the platen 27 communicates with the plurality of suction holes 44. Therefore, the through holes 56 formed in the cover member 54 fixed on the surface 27*a* of the platen 27 communicate with the plurality of suction holes 44 via the recess 60. Thus, in the through holes 56 sucked via the recess 60, the variation of the sucking force can be suppressed.

Followings may be modifications of the embodiment of the invention. In the above embodiment, other printing methods such as a screening printing method may be used in place of using the ejecting of the ink from the recording head 31. In this case, the paper 12 onto which the ink is adhered by the other printing methods is transported onto the platen 27 so that the ink is dried.

In the above embodiment, without driving the pulling-in driving roller 23, the sending-out driving roller 40 and the winding-driving shaft 43, the paper 12 may be manually placed onto the platen 27 and the cover member 54. Alternatively, the paper 12 of a rectangular shape may be mounted on a belt so as to be moved onto the platen 27 and the cover member 54.

In the above embodiment, the cover member 54 is not limited to metals such as an Al, Fe, Cu or alloys of them. Rather, the cover member 54 may be made of a resin or a glass as long as the through holes 56 can be made therein. Moreover, although the cover member 54 is preferably made of materials with the excellent thermal conductance, it may be made of air-permeable materials such as a sponge or a pelt. Similarly, this approach prevents the ink from flowing in large quantities from the center of the noncontact region C to boundaries between the region C and the contact region B, while the paper 12 is being sucked and held onto the cover member 54. Further, in case of using an elastic sponge, it is preferable that the force which is caused from dispersing of the negative pressure in the sucking suction holes 44 into the sponge and then is applied to the paper 12 is at a suitable level which does not deform the sponge.

In the above embodiment, the heaters 48, 49 and 50 may not be used. That is to say, heat is taken out from the platen 27 by the air flows in the suction hole 44 due to the driving of the fan 46. In this way, across the platen 27, a temperature of the suction hole 44 regions and its adjacent regions and a temperature of regions distant from the suction holes 44 regions are different each other. However, by holding the paper 12 on the cover member 54 having the through holes 56 of the smaller cross-sectional area, the coloring level difference due to the temperature difference can be suppressed.

In the above embodiment, the cover member 54 may be thicker than the platen 27 as long as the cover member 54 and the platen 27 can maintain therein an amount of heat sufficient to dry the ink adhered to the paper 12. That is to say, the cover member 54 and the platen 27 together preserve therein an amount of heat from the heaters 48, 49 and 50. Moreover, because the thicknesses of the member 54 and the platen 27 increase, it is easier to make the through holes 56 in the cover member 54, rather than only through holes 56 in one platen 27.

In the first embodiment, the cover member 54 may be provided with the through holes 56 with the same pitch as that of the suction holes 44. When the cover member 54 is stacked on the platen 27, the suction holes 44 communicate with one of the through holes 56 and the continuous form paper 12 can be sucked on the supporting face 54*a* through the through hole 56. Further, the through holes 56 may be formed only in regions in which the suction holes 44 are formed when being stacked. As a result, the number of the through holes 56 can be reduced, thereby making the formation of the cover member 54 easier.

In the second embodiment, the cover member 54 may be provided with the through holes 56 only in a region located on the suction holes 44 and the recess 60 when the cover member 54 is stacked on the platen 27. As a result, the number of the through holes 56 can be reduced, thereby making the formation of the cover member 54 easier.

In the above embodiment, a plurality of recesses for communicating the plurality of the through holes 56 to each other may be formed on a lower face 54*b* of the cover member 54. In this way, the negative pressure in the suction holes 44 can spread into more of the through holes 56, and, hence, the paper 12 can more reliably be sucked and held onto the supporting face 54*a*.

In the above embodiment, although the through holes 56 were punch-cut into the metal plate cover member 54, the cover member 54 may be an air permeable metal mesh which is formed by crossing metal wires. In this case, the spaces between the metal wires are smaller than the aperture diameter of the suction holes 44.

In the above embodiment, the target may be a water-repellent sheet such as a resin sheet or a metal sheet. In the above embodiment, the sucking unit is not limited to the fan 46, and the sucking unit may be a pump creating the negative pressure from the lower face 27*b* of the platen 27 into the suction holes 44.

In the second embodiment, the recess 60 may be formed to communicate with one suction hole 44.

In the second embodiment, a direction in which the recess 60 is formed is not limited to the front-rear direction or right-left direction, but may be formed to extend along an oblique direction. The shape of the recess 60 may be a spiral shape or annular shape. Further, shallow portions may be formed along opening edges of the suction holes 44 and recesses having a circular shape, elliptical shape, rectangular shape or the like, when seen in a plan view, may be formed.

In the second embodiment, the recess 60 is not limited to the rectangular shape when seen in a cross-sectional view, but may be formed into a V-shaped groove having a triangular shape when seen in a cross-sectional view, with side surfaces formed obliquely. The cross-sectional shape of the recess 60 can be arbitrarily set to a semicircular shape, elliptical shape or the like.

In the above embodiment, the liquid ejecting apparatus is specified by the ink jet printer 11, and may be other types of the liquid ejecting apparatus for ejecting other liquids other than the ink. Various liquid ejecting apparatuses may be employed which have a liquid ejecting head for ejecting a micro quantity level of liquid droplets may be employed. Here, the term "liquid droplet" means a liquid state in which the liquid is being ejected from the liquid ejecting apparatus, and this state includes a particle-like state, a tear-like state, a string-like state and a trailing state etc. Here, the term "liquid" means any material as long as the liquid ejecting apparatus can eject it in a liquid droplet state. For example, the material may be in a liquid state; in a fluid state in which there are high or low viscosity liquid materials, a sol, a water-gel, an inorganic solvent, an organic solvent, a solution, a liquid resin or a liquid metal (a metal melt); or in a kind of substance in which functional-material particles made of a solid material such as a pigment or a metal particle are dissolved, spread or mixed into a particular solvent. The typical examples of the liquid are the above-mentioned ink or a liquid crystal etc. Here, the term "ink" includes a known aqueous ink, a known oily ink, a known gel-ink, or a hot-melt ink etc. The specific examples of the liquid ejecting apparatus include a liquid ejecting apparatus for ejecting the liquid in which an electrode material or a color material used in manufacturing of a liquid crystal display, a electro luminescence display, a plane light-emitting display, or a color filter etc is spread or dissolved; a liquid ejecting apparatus for ejecting a bio-organic material used in manufacturing of a bio-chip; a liquid ejecting apparatus for ejecting a liquid as a test target used as a micro pipette; or a printing device or a micro dispenser etc. Additionally, a liquid ejecting apparatus for ejecting a lubricant into a pin point in a precision machine such as a clock or a camera; a liquid ejecting apparatus for ejecting a transparent resin liquid such as an ultraviolet-ray curing resin etc onto a substrate in order to form a micro hemisphere lens (an optical lens) used in a optical communication device; or a liquid ejecting apparatus for ejecting an etchant such as an acid solution or an alkali solution in order to etch a substrate etc may be employed. The present invention may be applied to any of those liquid ejecting apparatuses.

What is claimed is:

1. A liquid ejecting apparatus comprising:

a liquid ejecting unit that ejects a liquid onto a target;

a first supporting member having a plurality of first penetrating holes;

a second supporting member having a plurality of second penetrating holes formed therein and being stacked on and fixed to the first supporting member, the cross-sectional area of each of the second penetrating holes being smaller than the cross-sectional area of each of the first penetrating holes, wherein intervals between neighboring first penetrating holes are larger than diameters of the first penetrating holes;

a heating unit having a heater buried in the first supporting member; with a portion of the first supporting member disposed between the heating unit and the second supporting member and a sucking unit that sucks in the plurality of first penetrating holes and hence sucks in the plurality of second penetrating holes communicating with the plurality of first penetrating holes;

wherein the target is sucked and held onto the second supporting member due to the driving of the sucking unit.

2. A liquid ejecting apparatus according to claim 1, wherein the second supporting member is thinner than the first supporting member.

3. A liquid ejecting apparatus according to claim 1, wherein the second supporting member is a plate made of metal and flatness of the plate is maintained even in a case where there is negative pressure within the second penetrating holes.

4. A liquid ejecting apparatus according to claim 1, further comprising: a target transporting unit that slides the target on the second supporting member.

5. A liquid ejecting apparatus according to claim 1, wherein intervals between neighboring second penetrating holes are smaller than intervals between neighboring first penetrating holes.

6. A liquid ejecting apparatus comprising:

a liquid ejecting unit that ejects a liquid onto a target;

a first supporting member having a plurality of first suction holes and a recess formed to communicate with the first suction holes;

a second supporting member having a plurality of second suction holes formed therein and being stacked on and fixed to the first supporting member, the cross-sectional area of each of the second suction holes being smaller than the cross-sectional area of each of the first suction holes, wherein intervals between neighboring first suction holes are larger than diameters of the first suction holes;

a heating unit having a heater buried in the first supporting member with a portion of the first supporting member disposed between the heating unit and the second supporting member; and a sucking unit that sucks in the plurality of first suction holes and hence sucks in the plurality of second suction holes communicating with the plurality of first suction holes;

wherein the target is sucked and held onto the second supporting member due to the driving of the sucking unit.

7. A liquid ejecting apparatus according to claim 6, wherein the second supporting member is thinner than the first supporting member.

8. A liquid ejecting apparatus according to claim 6, wherein the second supporting member is a plate made of metal and flatness of the plate is maintained even in a case where there is negative pressure within the second suction holes.

9. A liquid ejecting apparatus according to claim 6, further comprising: a target transporting unit that slides the target on the second supporting member.

10. A liquid ejecting apparatus according to claim 6, wherein intervals between neighboring second suction holes are smaller than intervals between neighboring first suction holes.

* * * * *